US012589782B2

(12) United States Patent
Loy

(10) Patent No.: US 12,589,782 B2
(45) Date of Patent: Mar. 31, 2026

(54) SINGLE WHEELED KNUCKLE CARRIER

(71) Applicant: The Nolan Company, Canton, OH (US)

(72) Inventor: Robert Brian Loy, Navarre, OH (US)

(73) Assignee: THE NOLAN COMPANY, Canton, OH (US)

( * ) Notice: Subject to any disclaimer, the term of this patent is extended or adjusted under 35 U.S.C. 154(b) by 310 days.

(21) Appl. No.: 18/434,162

(22) Filed: Feb. 6, 2024

(65) Prior Publication Data

US 2024/0174272 A1 May 30, 2024

Related U.S. Application Data

(63) Continuation-in-part of application No. 17/366,279, filed on Jul. 2, 2021, now Pat. No. 11,945,485.

(51) Int. Cl.
*B61K 5/00* (2006.01)

(52) U.S. Cl.
CPC ..... *B61K 5/00* (2013.01)

(58) Field of Classification Search
CPC ... B61K 5/00; B61G 7/00; B61G 7/02; B61G 7/04; B61G 7/10; B61G 7/14; B62B 1/00; B62B 1/14; B62B 1/26; B62B 1/10; B62B 1/18; B62B 1/22; B62B 1/24
See application file for complete search history.

(56) References Cited

U.S. PATENT DOCUMENTS 2,983,520 A * 5/1961 Klages ..... B62B 5/06 414/444
3,170,708 A * 2/1965 Miller ..... B62B 5/0083 280/47.32
4,179,828 A * 12/1979 Brunty ..... E01H 1/12 56/400.05
4,691,563 A * 9/1987 Martin ..... B61L 15/02 246/167 R (Continued)

FOREIGN PATENT DOCUMENTS

CN 2695316 4/2005
DE 20109068 2/2002

(Continued)

OTHER PUBLICATIONS

Railroad Tools and Solutions, Inc., Two-Wheel Coupler Knuckle Cart, https://rrtools.com/product/two-wheel-coupler-knuckle-cart/, retrieved Feb. 6, 2024.

(Continued)

*Primary Examiner* — James M Dolak
(74) *Attorney, Agent, or Firm* — Sand, Sebolt & Wernow Co., LPA

(57) ABSTRACT

A compact single wheeled knuckle carrier which may be easily stowed and take up minimal space within the engine while simultaneously being easily maneuverable and robust enough to assist a person in carrying a train knuckle over rough terrain and over distance. The compact single wheeled knuckle carrier has a support member that couples the knuckle to the carrier and can include a slide lock to secure (Continued)

the knuckle to the support member. The compact single wheeled knuckle carrier has a pin holder that carries a pin that is used with the knuckle.

20 Claims, 13 Drawing Sheets

(56) References Cited

U.S. PATENT DOCUMENTS

| | | | | |
|---|---|---|---|---|
| 5,232,233 | A * | 8/1993 | Jedora | B63C 13/00 280/47.131 |
| 5,755,451 | A * | 5/1998 | O'Connor | B63C 13/00 280/47.32 |
| 5,884,920 | A | 3/1999 | Seto | |
| 6,193,290 | B1 * | 2/2001 | Barbara, Jr. | B61G 7/00 294/158 |
| 6,575,481 | B1 * | 6/2003 | Davis | B62B 5/0083 280/47.32 |
| 6,904,977 | B2 | 6/2005 | Zerrer et al. | |
| 6,955,367 | B1 * | 10/2005 | Simonsen | A47B 83/02 280/47.32 |
| 8,002,291 | B1 * | 8/2011 | Sandoval | B62B 5/0083 280/47.32 |
| 9,527,655 | B2 | 12/2016 | Kaufman | |
| 11,945,485 | B2 * | 4/2024 | Loy | B62B 1/14 |
| 11,999,401 | B2 * | 6/2024 | Smith | B62B 5/0438 |
| 12,030,542 | B2 * | 7/2024 | Anderson | B62B 1/14 |

FOREIGN PATENT DOCUMENTS

| | | | |
|---|---|---|---|
| JP | 11245822 | A | 9/1999 |
| JP | 2009262608 | A | 11/2009 |
| KR | 101716947 | | 3/2017 |
| RU | 2735878 | | 11/2020 |

OTHER PUBLICATIONS

Railroad Tools and Solutions, Inc., Two Wheel Knuckle Carrier, https://rrtools.com/product/two-wheel-knuckle-carrier/, retrieved Feb. 6, 2024.

* cited by examiner

SINGLE WHEELED KNUCKLE CARRIER

REFERENCE TO RELATED APPLICATIONS

This application is a continuation-in-part application of U.S. patent application Ser. No. 17/366,279, filed on Jul. 2, 2021; the disclosure of which is incorporated herein by reference.

TECHNICAL FIELD

The present disclosure relates generally to transport devices utilized in carrying replacement train knuckles.

BACKGROUND ART

Trains perform an important transportation function around the world, including the transportation and movement of goods and people over long distances and at potentially very high speeds. Trains typically consist of a powered car commonly referred to as an engine or locomotive and a series of rail cars, which may be commonly referred to as train cars or railroad cars. These rail cars may be used in the transport of goods and materials across a distance as part of a cargo or freight train or may be used to transport people as part of a passenger train. While these rail cars tend to take many different forms and include many different types, rail cars tend to include one common component, namely, the coupling mechanisms which are commonly referred to as coupling knuckles or, simply, knuckles.

While these knuckles may take different forms and operate in different manners, they are generally standardized to fit rail cars of different types and different configurations across regions. For example, a common coupler known as the Janney coupler, is commonly used in North America, Japan, Australia, New Zealand, South Africa, Brazil, China, and elsewhere. As trains can be long and carry significant weight, these knuckles are quite robust, often weighing around 100 pounds or more to support the weight of the train being pulled by the engine or locomotive. Although they are robust, these knuckles are subjected to extreme stress and have a tendency to break over time. Thus, it is common that a train will have additional knuckles for use as replacements in the event of a knuckle break or failure.

Modern trains, particularly freight trains, can be extremely long, sometimes stretching longer than a mile or more from engine to the last car. In the event of a knuckle break, the engineer and/or other railroad employees must typically transport a new knuckle from its storage location in the engine to the location of the break. Again, as knuckles can be very heavy, typically around 100 pounds, and trains can be long, this may result in difficulty for the person or persons responsible for transporting a replacement knuckle to the location of the break.

Currently, knuckle carriers exist to alleviate the burden of carrying a 100 pound or more components over a great distance; however, each of the current solutions available has additional shortcomings. First, it is common for two persons to carry a knuckle in tandem utilizing a solid straight bar which may be inserted through an aperture in the knuckle and supported on each end by a person. These set ups still require the full weight of the knuckle plus the weight of the bar to be borne by individuals and carried over what could be a significant distance resulting in fatigue, wasted time, and even a high potential for injury to the persons carrying the knuckle, especially considering that the terrain that the two-person tandem team must traverse. Other carriers utilizing wheeled dollies and the like tend to have two wheels and a significant support system which can be bulky and heavy of its own as well as may occupy a large amount of space for storage and transport within the engine or in the compartment. While they alleviate the stress on the user, these carriers take up space in an area, such as the cabin or a compartment in the engine, where space is inherently limited and may be heavy and difficult to maneuver in and of themselves.

SUMMARY OF THE INVENTION

The present disclosure addresses these and other issues by providing a compact single wheeled knuckle carrier which may be easily stowed and take up minimal space within the engine, or other location on the train, while simultaneously being easily maneuverable and robust enough to assist a person in carrying a train knuckle over rough terrain and over distance.

In one example, the present disclosure relates to a one-wheeled carrier operable to support and carry a train car coupling knuckle. Specifically, in another example, the present disclosure relates to a compact single wheeled train car knuckle carrier operable to transport a train car knuckle over distance while occupying minimal space within a train engine or storage area.

In one aspect, an exemplary embodiment of the present disclosure may provide a knuckle carrier comprising: a body having a handle at a first end thereof; a single wheel at a second end of the body of the knuckle carrier; a support plate attached to the body of the knuckle carrier proximate the wheel; a support member extending vertically from the support plate and parallel to the body of the knuckle carrier, the support member being configured to carry a coupler knuckle; and a slidable lock plate operable to lock the coupler knuckle in place on the support member.

In another aspect, an exemplary embodiment of the present disclosure may provide a method of transporting a coupler knuckle comprising: sliding a lock plate to a first position on a body of a knuckle carrier, wherein the lock plate is not engaged with a support member extending parallel to the body and vertically from a support plate connected to the body of the knuckle carrier; engaging a coupler knuckle with the support member; sliding the lock plate from the first position to a second position on the body of the knuckle carrier wherein the lock plate engages the support member; and moving the knuckle carrier from a first location to a second location using a single wheel connected thereto.

In yet another aspect, an exemplary embodiment of the present disclosure may provide a method of replacing a coupler knuckle comprising: removing a single-wheeled knuckle carrier from a storage position within an engine of a train; sliding a lock plate to a first position on a body of the knuckle carrier, wherein the lock plate is not engaged with a support member extending parallel to the body and vertically from a support plate connected to the body of the knuckle carrier; engaging a first coupler knuckle with the support member; sliding the lock plate from the first position to a second position on the body of the knuckle carrier wherein the lock plate engages the support member; moving the knuckle carrier from a first location to a second location via the single wheel; removing the first coupler knuckle from the knuckle carrier when the knuckle carrier is in the second location; and replacing a second coupler knuckle on a rail car with the first coupler knuckle.

In yet another aspect, an exemplary embodiment of the present disclosure may provide a knuckle carrier comprising: a body having a first end and a second end; a handle at the first end of the body; a single wheel at the second end of the body; a knuckle attachment assembly including a support member coupled to the body of the knuckle carrier, the support member configured to carry a coupler knuckle; and a pin holder coupled to the body, the pin holder configured to hold a pin that is adapted to interact with the coupler knuckle when both are removed from the knuckle carrier. This exemplary embodiment or another exemplary embodiment may further provide a support plate attached to the body proximate the wheel; wherein the support member extends vertically from the support plate, wherein the support plate and the support member are located on a different side of the body than the pin holder; and a slidable lock plate operable to lock the coupler knuckle in place on the support member. This exemplary embodiment or another exemplary embodiment may further provide a flange attached to the body proximate the wheel; wherein the pin holder is connected to the flange and spaced apart from the body. This exemplary embodiment or another exemplary embodiment may further provide a top edge of the flange and a bottom edge of the flange; a support plate attached to the body proximate the wheel; wherein the top edge of the flange is located at greater vertical height than the support plate; wherein the support member extends vertically from the support plate and/or wherein the bottom edge of the flange is located at lower vertical height than the support plate, wherein the support plate and the support member are located on a different side of the body than the pin holder. This exemplary embodiment or another exemplary embodiment may further provide a support gusset connected to the body and the support plate, wherein a lower end of the support gusset is located at a lower vertical height than a top edge of the flange and/or wherein a lower end of the support gusset is located at a lower vertical height than a bottom edge of the flange. This exemplary embodiment or another exemplary embodiment may further provide that the pin holder is on an opposite side of the body than the support member. This exemplary embodiment or another exemplary embodiment may further provide a length of the pin holder; a length of the support member, wherein the support member is longer than the pin holder. This exemplary embodiment or another exemplary embodiment may further provide an external diameter of the tubular metal that forms of the support member, wherein the external diameter is smaller than an internal diameter of an aperture defined in the coupler knuckle. This exemplary embodiment or another exemplary embodiment may further provide an internal diameter of the tubular metal that forms the pin holder, wherein the pin holder has an enclosed bottom and an open top so as to receive the pin within a bore of the tubular metal, wherein the internal diameter is larger than an external diameter of the pin that is held by the pin holder. This exemplary embodiment or another exemplary embodiment may further provide a first curved portion and a second curved portion; a straight section located between the first curved portion and the second curved portion; at least one aperture formed in the straight section, wherein the at least one aperture in the straight section is configured to receive a connector for an attachment that couples with the straight section. This exemplary embodiment or another exemplary embodiment may further provide that the attachment that connects with the straight section is a cross bar that establishes a T-handle. This exemplary embodiment or another exemplary embodiment may further provide that the second curved portion is located above the cross bar. This exemplary embodiment or another exemplary embodiment may further provide that the coupler knuckle is supported by the knuckle carrier in a position above the body of the knuckle carrier when the knuckle carrier is operated at an acute angle relative to a ground surface; and that the pin is carried by the pin holder in a position below the body of the knuckle carrier when the knuckle carrier is operated at an acute angle relative to a ground surface.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
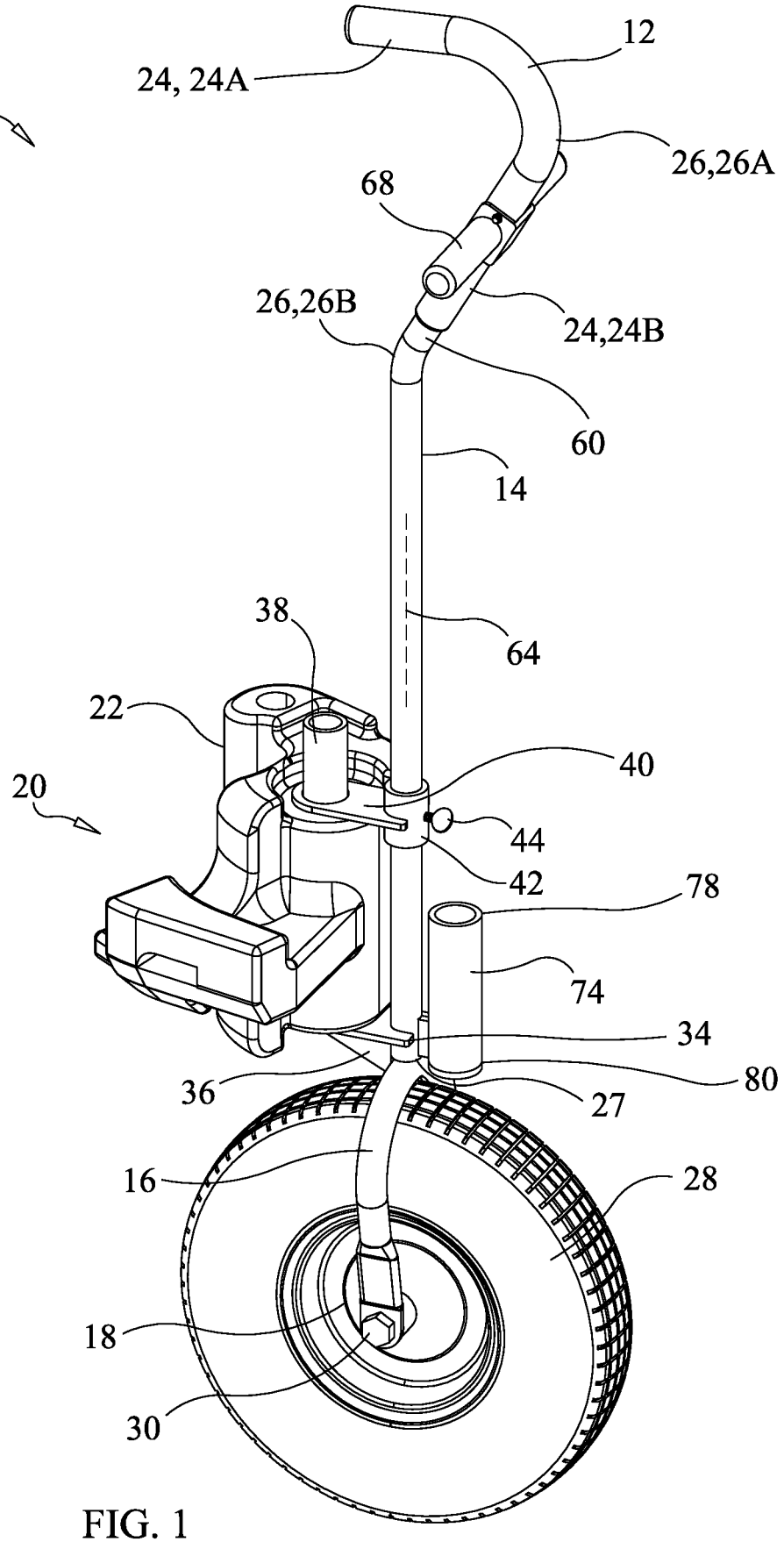
FIG. 1 (FIG. 1) is a left side perspective isometric view of a compact knuckle carrier, according to one aspect of the present disclosure.
Figure 2:
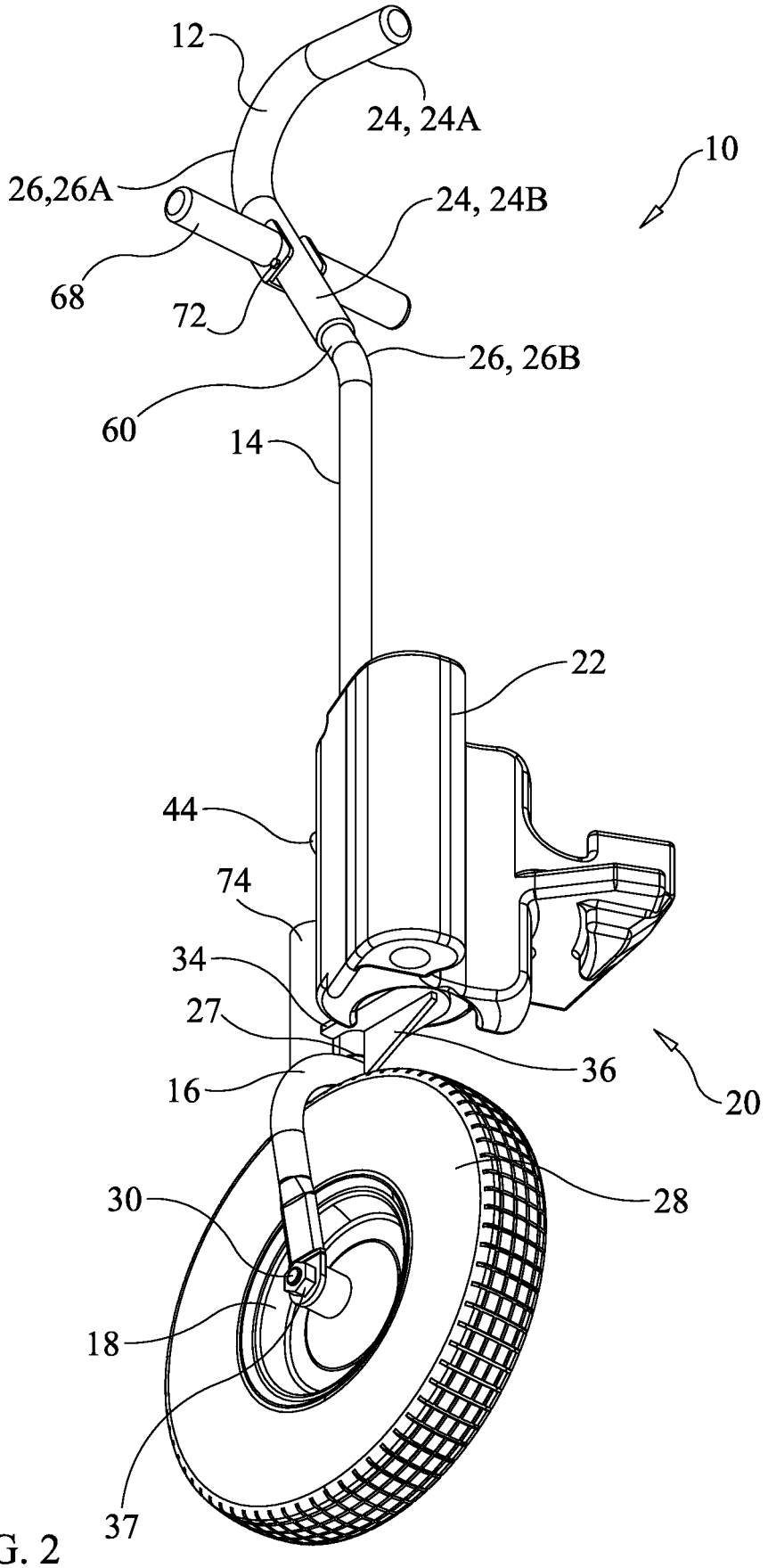
FIG. 2 (FIG. 2) is a front lower perspective right side isometric view of a compact knuckle carrier of the present disclosure.
Figure 3:
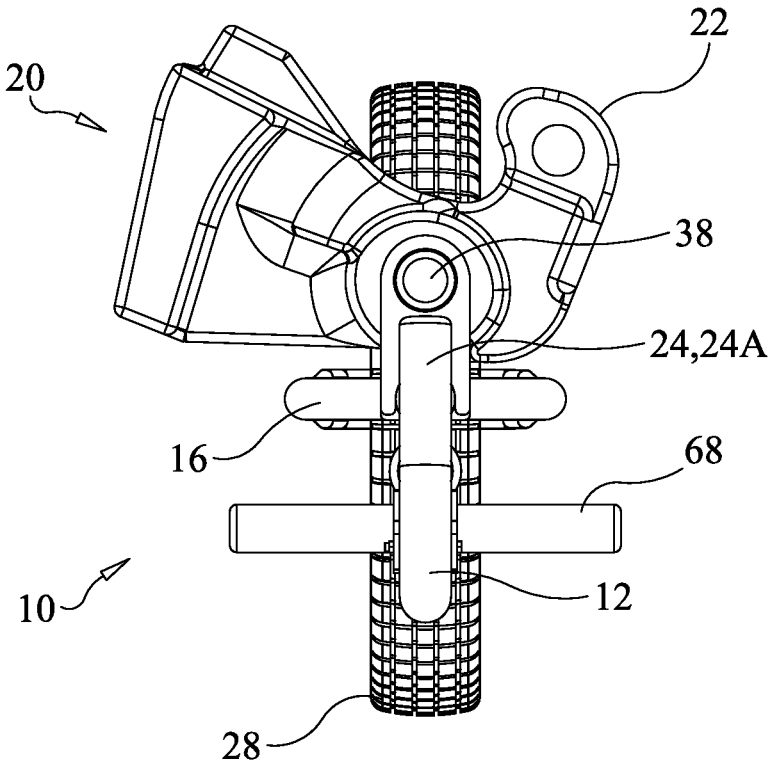
FIG. 3 (FIG. 3) is a top plan view of a compact knuckle carrier of the present disclosure.
Figure 4:
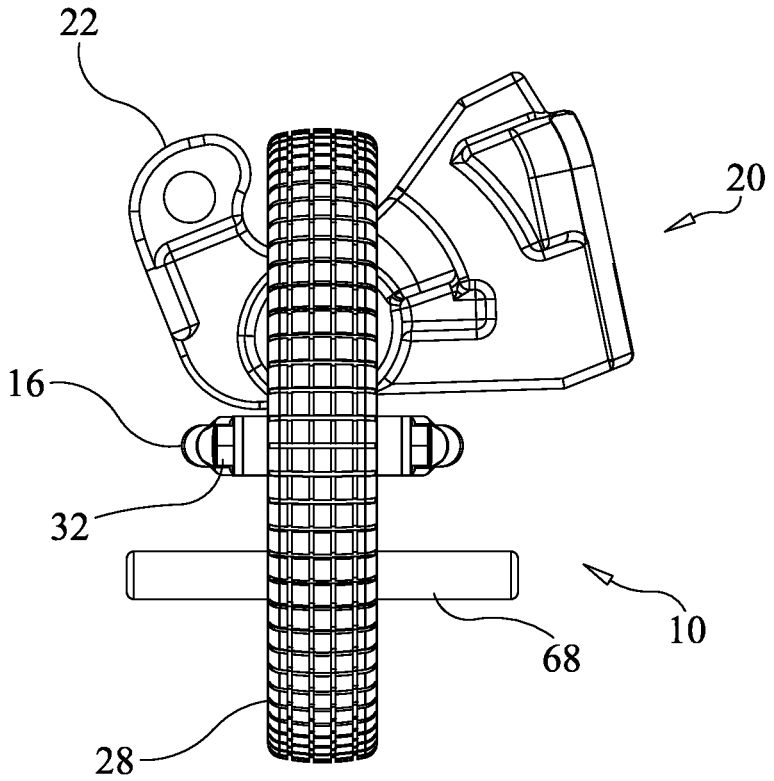
FIG. 4 (FIG. 4) is a bottom plan view of a compact knuckle carrier, according to one aspect of the present disclosure.
Figure 5:
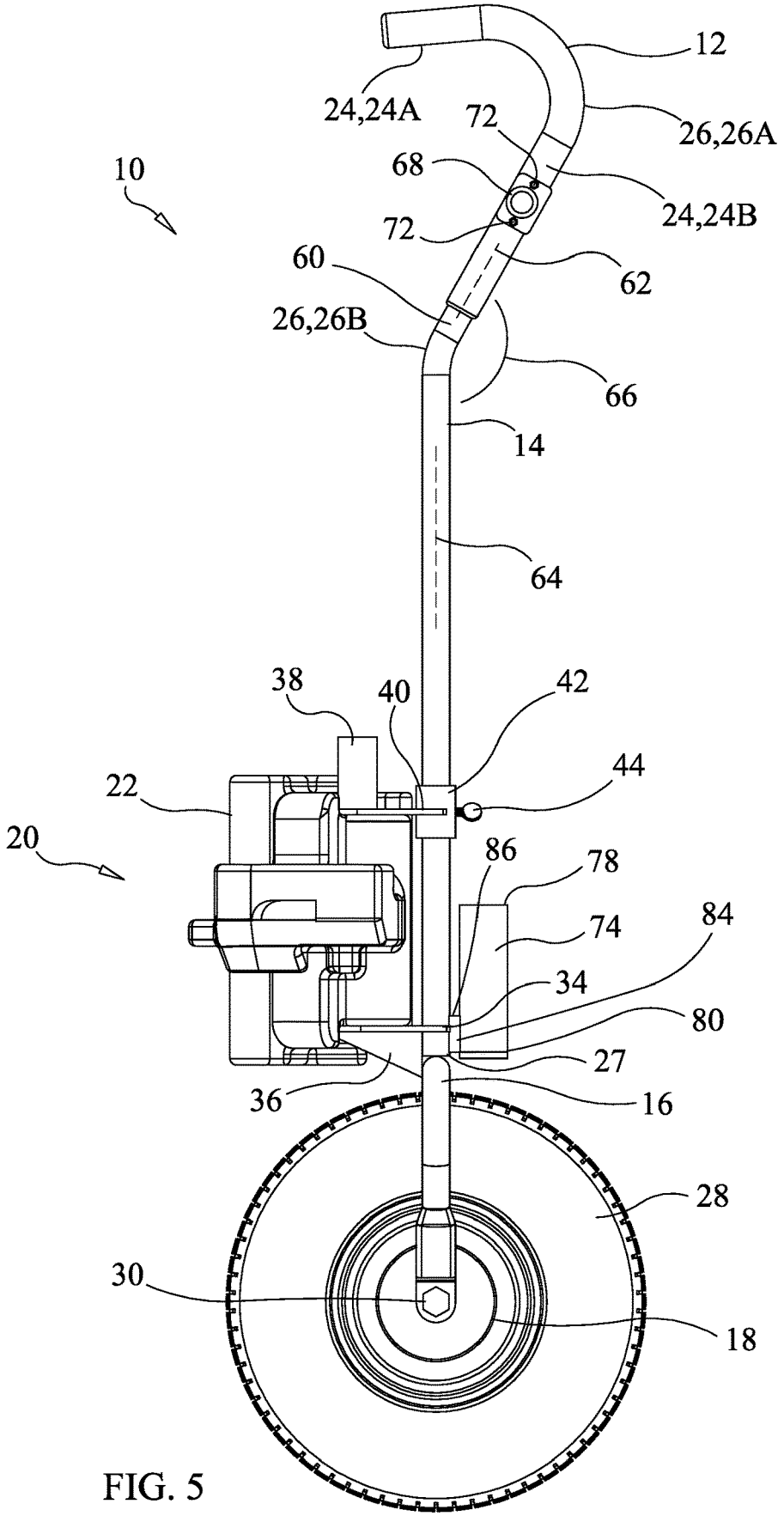
FIG. 5 (FIG. 5) is a left side elevation view of a compact knuckle carrier, according to one aspect of the present disclosure.
Figure 6:
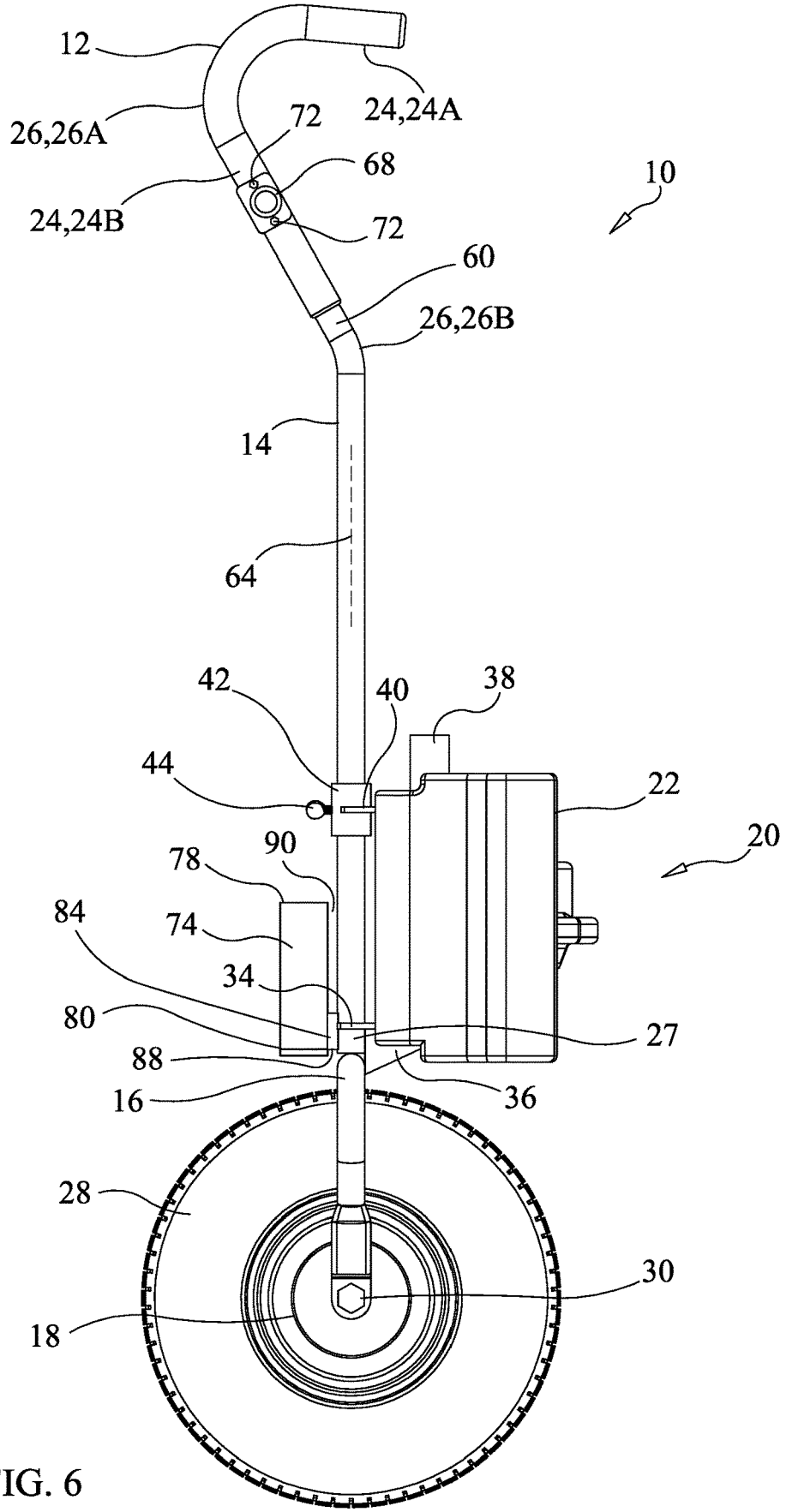
FIG. 6 (FIG. 6) is a right side elevation view of a compact knuckle carrier, according to one aspect of the present disclosure.
Figure 7:
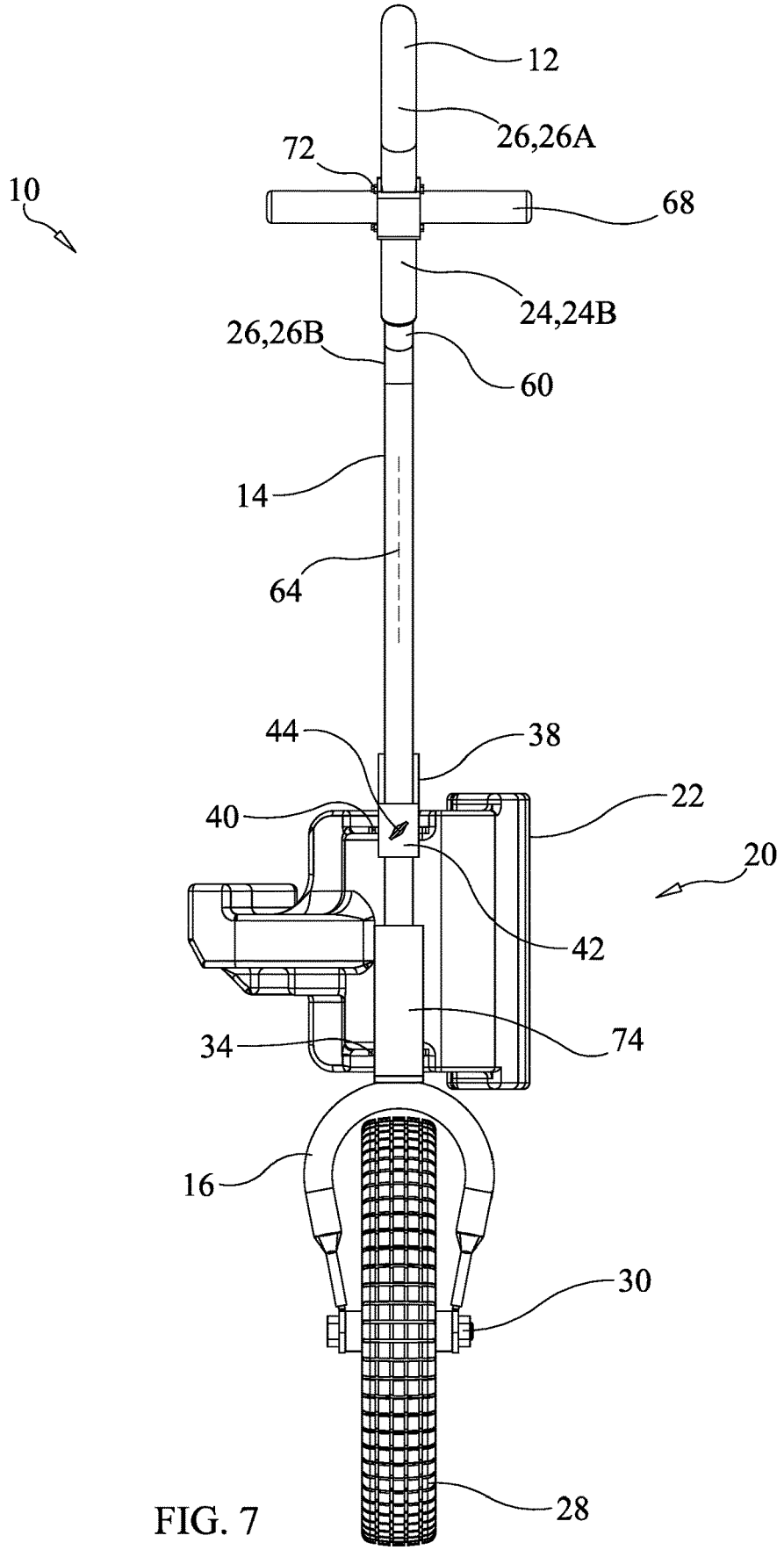
FIG. 7 (FIG. 7) is a rear elevation view of a compact knuckle carrier, according to one aspect of the present disclosure.
Figure 8:
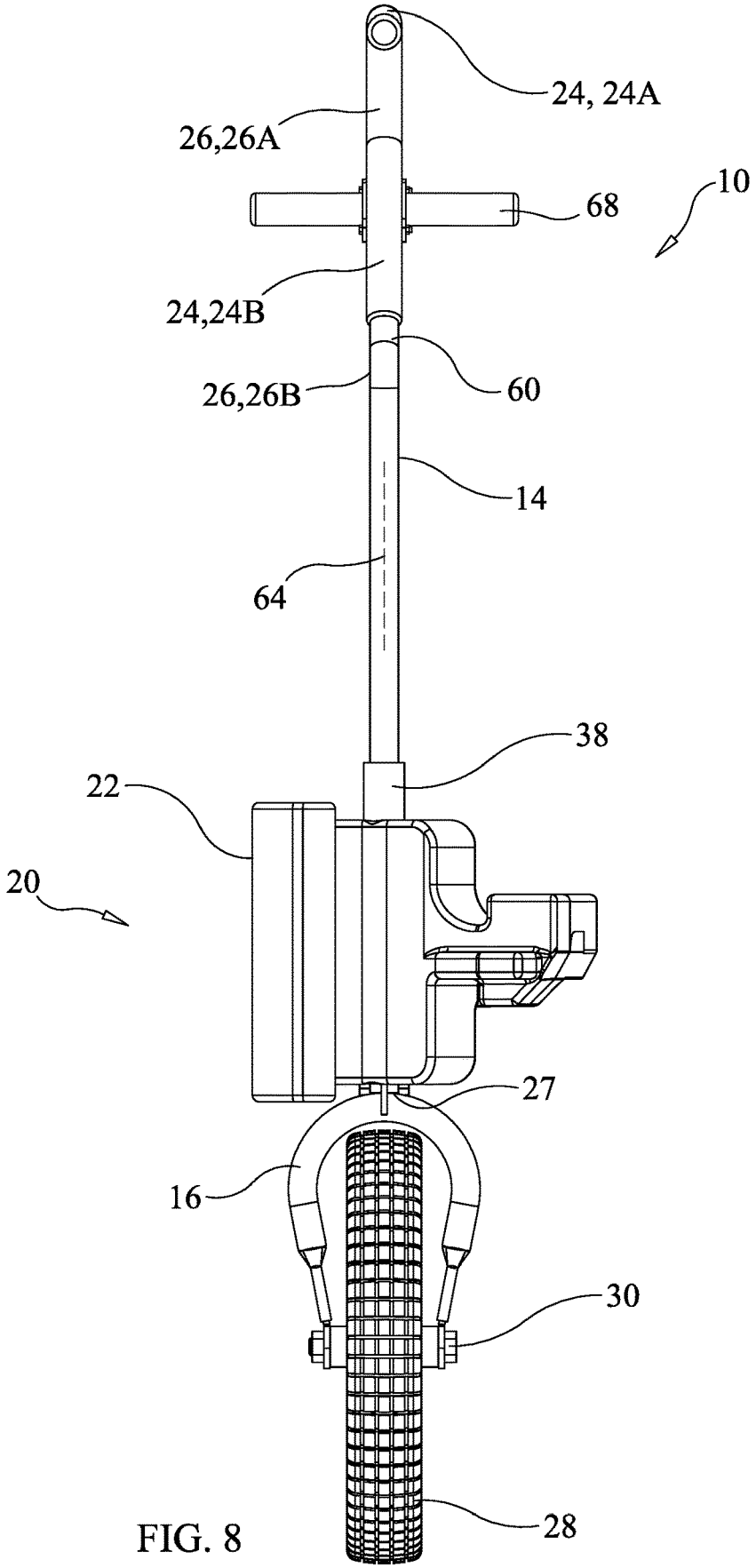
FIG. 8 (FIG. 8) is a front elevation view of a compact knuckle carrier, according to one aspect of the present disclosure.
Figure 9:
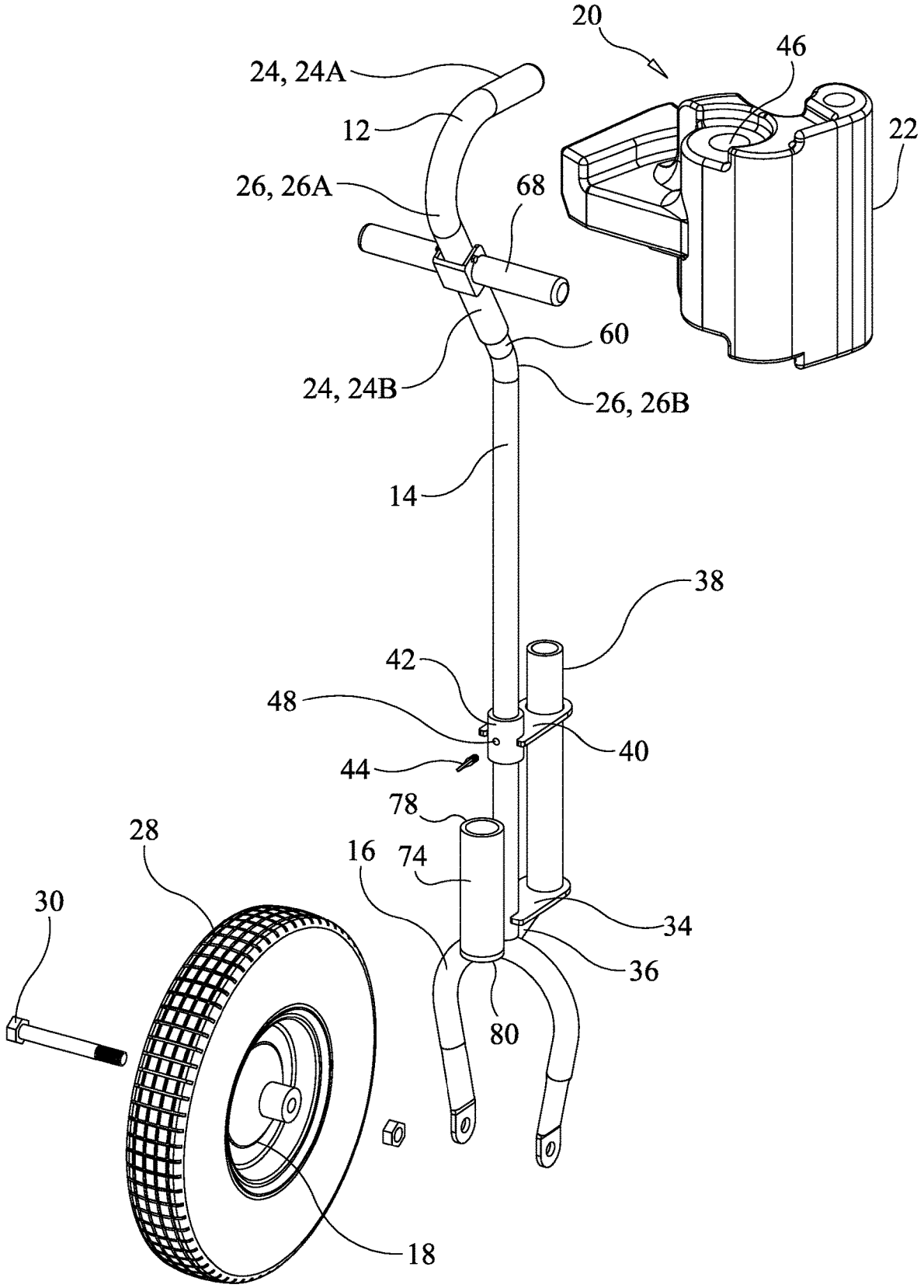
FIG. 9 (FIG. 9) is an exploded rear perspective view of a compact knuckle carrier, according to one aspect of the present disclosure.
Figure 10:
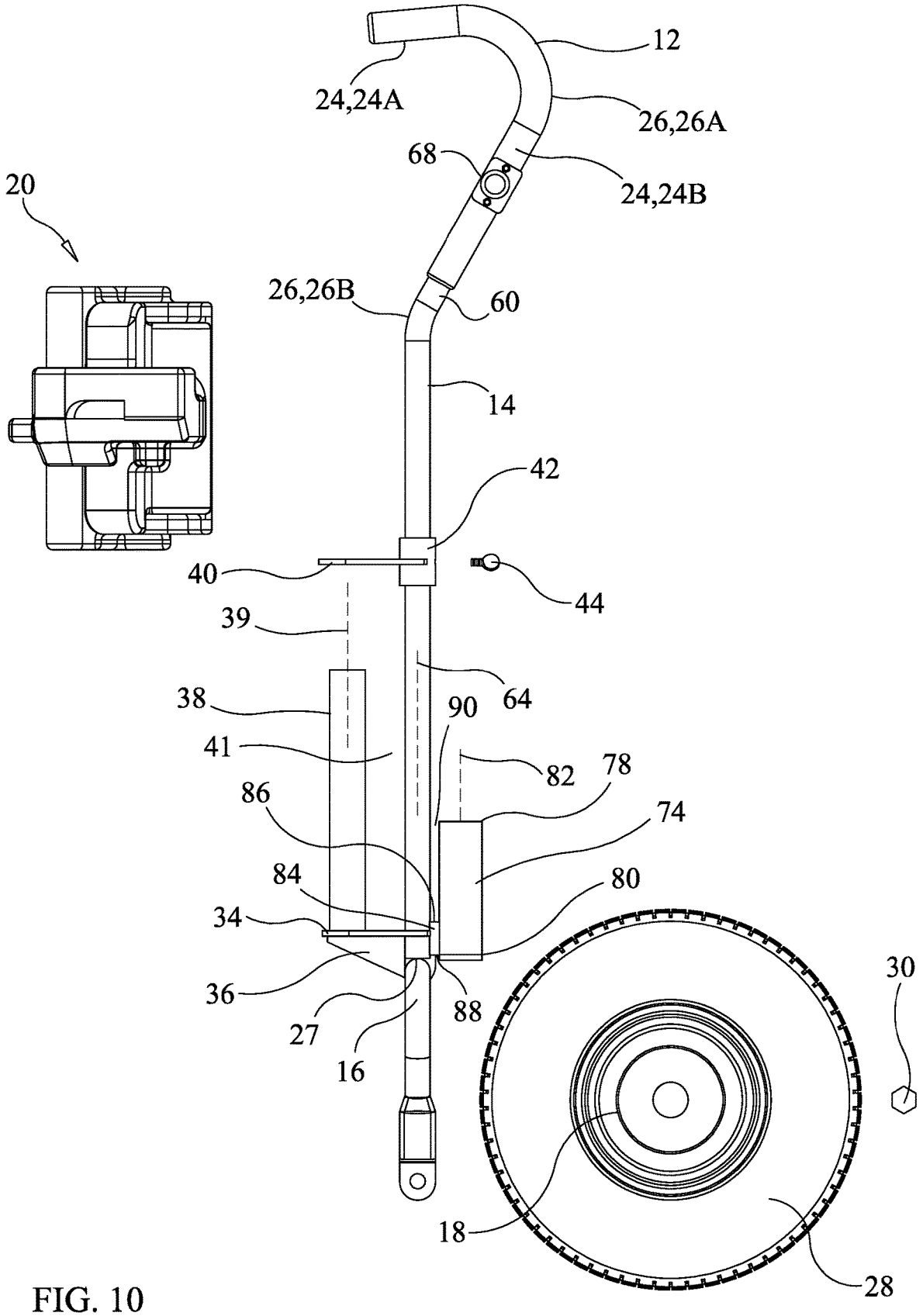
FIG. 10 (FIG. 10) is a left side elevation exploded view of a compact knuckle carrier, according to one aspect of the present disclosure.

With reference to FIG. 1 through FIG. 14, a single wheeled compact knuckle carrier is shown and generally referenced as carrier 10. Carrier 10 may include a handle 12, a body 14, a wheel fork 16 and ground-engaging wheel 18. Carrier 10 may further include a knuckle attachment assembly 20 operable to interact with and hold a train coupling knuckle 22, as discussed further herein.

The body 14 may be a unibody that is integrally extruded, molded, printed, or additively manufactured, removably machined, or formed as a unitary, monolithic member substantially fabricated from a rigid, manmade, material. In one example, metal or metal alloys, such as steel, stainless steel or aluminum alloy, may form a substantial majority of the components or elements used to fabricate the body 14 and the various components integrally formed, molded, or extruded therewith. The rigid body 14 should withstand typical train mechanical forces from an operator manipulating the body 14 to carry the knuckle coupler 22 with the knuckle attachment assembly 20. While it is contemplated that the body 14 and its additional components described herein are uniformly and integrally formed, bent, or molded, it is entirely possible that the components of the body 14 be formed separately from alternative materials as one having routine skill in the art would understand. Furthermore, while the components of the tool body are discussed below individually, it is to be clearly understood that the components and their corresponding reference elements of the tool body are portions, regions, or surfaces of the body 14 and all form a respective element or component of the unitary body 14. Thus, while the components may be discussed individually and identified relative to other elements or components of the body 14, in this exemplary embodiment, there is a single body 14 having the below described portions, regions, or surfaces.

The body 14 of carrier 10 may be generally formed of a single length of material such as tubular steel or other similar materials and may extend vertically between handle 12 at a first end and wheel fork 16 at a second end opposite therefrom. Accordingly, handle 12 and body 14 may be integrally formed and may be shaped ergonomically, as discussed further herein, to assist and operator in utilizing carrier 10, as discussed below. Alternatively, handle 12 may be separate and distinct from yet connected to body 14 through any suitable means including mechanical fasteners, welding, epoxies, adhesives, or the like. The body 14 has a length measured from the first end to the second end. In one embodiment, the length of the handle is in a range from about 35 inches to about 50 inches. In one particular embodiment, the length of the handle is about 40 inches.

Body 14 may then be an elongated generally vertical member extending between handle 12 at a first end and wheel fork 16 at the second end and may be, as discussed above, a generally straight section of tubular steel or other similar materials, as dictated by the desired implementation. When the body 14 is formed from tubular steel, it has an external diameter. The external diameter of the body 14 may be in a range from about 0.75 inches to about 1.5 inches. In one particular embodiment, the external diameter of the body 14 is about 1.05 inches. The ranges of these diameters should be selected, and may provide some criticality, to balance weight considerations versus strength requirements of carrier 10.

Handle 12 may further include one or more grip portions and/or grips indicated in figures at reference numeral 24. As shown and described herein, handle 12 may include a first grip 24A and a second grip 24B. Grips 24 may be placed strategically on handle 12 to provide multiple gripping surfaces that may be both ergonomically comfortable while providing maximum surface area for an operator to grip handle 12. Grips 24 may be any suitable material which may be placed over handle 12 such as rubber, leather, or the like, or may be textured material or textured sections of handle 12 such as a rubberized coating and/or knurled surface or the like, as dictated by the desired implementation.

Handle 12 may further include one or more bent sections indicated at reference 26, which may give handle 12 an ergonomic contour to allow ease in handling an operation while utilizing carrier 10, as discussed below. According to one example, handle 12 may include a first curved portion 26A which may provide that first grip 24A may be substantially parallel with a ground surface when the length of body 14 of carrier 10 aligned directly vertical. The first curved portion 26A may be located along the length of the body. In one exemplary embodiment, the first curved portion 26A is located approximately 65% from the second end of the body 14 where the joint 27 is established with wheel fork 16. Thus, if the length of the body 14, measure from the joint 27 to the end of handle 12 is about 40 inches, then the first curved portion 26A is located at about 26 inches from the joint 27.

Further, according to this example, handle 12 may then include a second curved portion 26B to provide handle 12 with the proper contour while rejoining handle 12 with body 14. In one exemplary embodiment, the second curved portion 26B is located approximately 90% from the second end of the body 14 where the joint 27 is established with wheel fork 16. Thus, if the length of the body 14, measure from the joint 27 to the end of handle 12 is about 40 inches, then the second curved portion 26B is located at about 36 inches from the joint 27.

The first curved portion 26A and the second curved portion 26B each have a radius of curvature associated with the curve. In one exemplary embodiment, the radius of curvature for the first curved portion 26A and the second curved portion 26B are the same but the curves cause the tubing forming the body 14 to curve or bend in opposition directions. For example, the radius of curvature of the first curved portion 26A and the second curved portion 26B may both be about 2.5 inches, but the first curved portion 26A causes the straight section to extend in a first direction and the second curved portion causes a top section of the handle to extend in an opposite second direction. The length of the top section of handle 12, which is measure from the second curved portion 26B to the terminal end of the top section is a range from about 3 inches to about 10 inches. Further, the top section of the handle may also be slightly angled, such as about 5° from the end of the second curved portion 26B.

There may be a straight section 60 located between the first curved portion 26A and the second curved portion 26B. The straight section 60 may extend along a section axis 62 that is angled relative to the longitudinal axis 64 of the body 14. In one embodiment, the angle 66 formed between the section axis 62 and the longitudinal axis 64 of the body 14 is greater than 90°. In one particular embodiment, the angle 66 formed between the section axis 62 and the longitudinal axis 64 of the body is in a range from about 110° to about 170°. In one specific embodiment, the angle 66 formed between the section axis 62 and the longitudinal axis 64 of the body 14 is about 151°. There may be some criticality to the above mentioned ranges that assist with weight distribution and maneuverability of the carrier 10 for moving the knuckle 22 when it is attached to carrier 10, as will be described in greater detail herein. The straight section 60 may be covered with first grip 24A.

The length of the straight section 60 between the first curved portion 26A and the second curved portion 26B may be in a range from about 6 inches to about 18 inches. The length of the straight section 60 should optimize the ergonomics of handle 12. In one particular embodiment, then length of the straight section is about 11 inches.

Carrier 10 may also include cross bar 68 that is connected to the straight section 60 between the first curved portion 26A and the second curved portion 26B to provide an improvement to handle 12. The cross bar 68 connected to the straight section 60 establishes a type of T-handle that provides a comfortable and ergonomic grip for the user, allowing for increased control and ease of use. The horizontal cross bar 68 of the "T-handle" provides a surface for the user to apply force or grasp with both hands, making it easier to control the movement of the carrier 110 when carrying the knuckle 22 on the knuckle attachment assembly 20. The length of the cross bar 68 can be configured to accommodate hand positioning on each side of the cross bar 68. For example, the overall length of the cross bar 68 may be in a range from about 8 inches to about 20 inches. This would result in, with the body 14 or section 60 centrally intersecting the cross bar 68, each side of the cross bar 68 being about 4 inches to about 10 inches to accommodate the placement of each hand to control and pull/push the carrier 10.

In one embodiment, the cross bar 68 may be selectively connected to the straight section 60. Namely, there may be holes 70 formed in the straight section 60 that would permit the operator to selectively connect the cross bar 68 to the straight section 60 to establish the T-handle by inserting bolts 72 through a portion of the cross bar 68 and the holes 70 in the straight section 60. By enabling the cross bar 68 to be removable, the carrier 10 can be stored in the locomotive cabin without taking up the extra space that would be required due to the increase width of the carrier when the T-handle is established by the cross bar 68 being connected to the straight section 60. Alternatively, another embodiment can provide the that cross bar 68 is integrally formed with or welded to the straight section 60 so that it is not removable. The T-handle is advantageous in carrier 10 for when more control or more torque is required than what can be achieved with a traditional straight handle.

Wheel fork 16 may be joined to body 14 at joint 27 which may be a fixed or permanent connection such as through welding or the like, or may be a movable connection such as a swivel or the like. Alternatively, joints 27 may be formed using mechanical fasteners such as bolts, screws, or the like to allow wheel fork 16 and wheel 18 to be removed from body 14, as desired and/or as necessary. Wheel fork 16 may be of suitable width and length to accommodate a wheel 18 with a tire 28 installed thereon of varying sizes, according to the desired implementation. Still further, it is possible for joint 27 to form a pivot joint. The pivot joint 27 would enable front wheel fork 16 to rotate relative to the body 14 in response to the movement of the handle 12. This type of joint 27 is commonly known as a headset. The wheel fork 16 is the part of the carrier 10 that holds the single wheel 18 and tire 28. There could be a head tube located at the lower end of the body, and within the head tube could be bearings (e.g., ball bearings or cartridge bearings or needle bearings) that allow smooth rotation. The fork 16 could have a tube called the steerer tube, which extends through the head tube. The upper end of the steerer tube would be attached to the handle 12. A stem is a component that could connect the handle 12 to the steerer tube. The joint between the steerer tube and the head tube acts as a pivot point. When the operator turns the handle 12, it would cause the wheel fork 16 to rotate around this pivot point.

Wheel fork 16 has a U-shaped configuration or horseshoe configuration with two ends facing downward. The wheel fork 16 can be formed of tubular steel having a vertical dimension that is about 8.5 inches from the top of the inverted U-shape to the lower ends. Each lower end of the wheel fork can be pinched or narrowed to have a smaller dimension that the diameter of upper portion of the fork 16.

Wheel 18 and tire 28 may be any standard or suitable wheel and tire arrangement including standard steel wheels 18 with pneumatic tire 28, solid tire 28 and/or a fully integrated wheel and tire system, again as dictated by the desired implementation. According to one aspect, wheel 18 and tire 28 may be a solid urethane, polyurethane, or other suitable material flat-free or puncture resistant wheel/tire combination; however, it will be understood that any suitable wheel and tire arrangement may be utilized. Wheel 18 and tire 28 may be connected wheel fork 16 via a bolt 30 and nut 32, as pictured, or through any other suitable attachment mechanism wherein wheel 18 and tire 28 may rotate and/or spin relative to carrier 10 through principles of normal operation. According to the example shown and described herein, wherein wheel 18 and tire 28 are attached via bolt 30 and nut 32, bolt 30 and nut 32 may generally form an axle about which wheel 18 and tire 28 may spin. Wheel 18 and tire 28 may include a braking system operatively coupled thereto with a brake control connected to any portion of the body 14 or handle 12 that would allow an operator to effectuate a braking action of the wheel 18 and tire 28 through actuation of the brake control. Wheel 18 and/or tire 28 may be any suitable size having any suitable diameter, width, tread depth, height, or the like. According to one aspect, wheel 18 and/or tire 28 may be a sixteen inch (16") diameter wheel/tire combination. The length of the carrier 10 measured in the longitudinal direction from the bolt 30 on wheel fork 16 to the end of the handle 12 is about 50 inches.

Knuckle attachment assembly 20 may be formed and/or connected to body 14 and may further include a support plate 34 with a support gusset 36, a support member 38, movable lock plate 40 and lock collar 42. Knuckle attachment assembly 20 or simply knuckle assembly 20 may be operable to support, carry, and secure a knuckle 22 to carrier 10 for transport thereof, as described further herein. In particular, support member 38 may pass through an aperture 46 defined through knuckle 22 (best seen in FIG. 9 and FIG. 11).

Support plate 34 and gusset 36 may be fixedly attached to body 14 at or near wheel fork 16 through any suitable means including welding, mechanical fasteners, or the like, or any suitable combination of attachment mechanisms. However, it is possible for the support plate 34 to be affixed closer to handle 12, yet this may be less desirable as the center of gravity of the carrier should be as low as possible to provide greater stability of the carrier 10 when the knuckle 22 is attached. Support plate 34 and gusset 36 may be formed of any suitable material provided that is configured and sufficiently strong enough to support the weight of knuckle 22 over repeated uses of carrier 10, as well as during transport of knuckle 22, which may be performed over rough terrain. According to one non-limiting example, as shown and described, support plate 34 and gusset 36 may be formed of steel of sufficient thickness and size, as to impart the desired strength to support knuckle 22 and may be welded to body 14 and/or wheel fork 16 to impart suitable strength thereto.

Support plate 34 has one end that is connected to the body 14 and a free end opposite the end connected to the body 14. The support plate 34 may have a length measured between these ends that ranges from about 3 inches to about 6 inches. In one particular embodiment, the length of the support plate is about 4.5 inches. Support plate 34 may also include an arcuate cutout at the end that connects with the body 14. The arcuate cutout in support plate 34 is configured to receive the body therein. Thus, when the body 14 is formed of tubular steel, the radius of curvature of the cutout should be closely complementary to the external radius of curvature of the body 14 effectuating a snug fit that can be welded together. In one exemplary embodiment, the radius of curvature of the arcuate cutout on the support plate 34 is in a range from about 0.4 inches to about 0.6 inches. Additionally, when the body 14 is formed of tubular steel, the diameter the cutout should be closely complementary to the external diameter of the body 14 effectuating a snug fit that can be welded together. In one exemplary embodiment, the diameter of the arcuate cutout on the support plate 34 is about 1.06 inches when the external diameter of the body 14 is 1.05 inches. This effectuates a snug fit so the plate 34 and body 14 can be welded together.

Support member 38 may then extend directly straight, linearly and vertically along support member axis 39 from support plate 34 and may generally be parallel to body 14. Axis 39 is offset parallel to axis 64 of body 14. A gap 41 is defined between support member 38 and body 14. Support member 38 may be a section of tubular steel or similar materials suitably sized to secure knuckle 22 to knuckle assembly 20, as described further herein. More particularly, support member 38 has a diameter that is complementary to or slightly smaller than the diameter of aperture 46 on knuckle 22 to allow the support member 38 to slidably receive the knuckle thereon through the aperture 46. Support member 38 may have a length measured end-to-end that is in a range from about 8 inches to about 14 inches. In one particular embodiment, the length of the support member may be about 11 inches.

In one embodiment, the support member 38 has an external diameter that is less than the interior diameter of the aperture 46 on the knuckle 22 that it shall carry. Thus, when the aperture 46 of knuckle 22 has an internal diameter, the exterior diameter of the support member 38 should be less than that internal diameter of the aperture 46. In one particular embodiment, the external diameter of the support member 38 is at least 5% less than the internal diameter of aperture 46 of knuckle 22 that is to be carried by the support member 38. In another particular embodiment, the external diameter of the support member 38 is at least 10% less than the internal diameter of aperture 46 of knuckle 22 that is to be carried by the support member 38. In yet another particular embodiment, the external diameter of the support member 38 is at least 25% less than the internal diameter of aperture 46 of knuckle 22 that is to be carried by the support member 38. In each embodiment, the external diameter of the tubular steel forming the support member 38 should be engineered to meet strength and load-bearing criteria, balancing the need for robustness with considerations for weight and space constraints. In an exemplary embodiment, the external diameter of the support member 38 is in a range from about 1.5 inches to about 2 inches. In one particular embodiment, the external diameter of the support member 38 is in a range from about 1.5 inches to about 1.66 inches.

Additionally, the external diameter of support member 38 may be greater than the external diameter of the body 14. The external diameter of the support member 38 may be at least 5% greater the external diameter of tubular steel forming body 14. In another embodiment, the external diameter of the support member 38 may be at least 10% greater the external diameter of tubular steel forming body 14. In yet another embodiment, the external diameter of the support member 38 may be at least 25% greater the external diameter of tubular steel forming body 14. In yet another embodiment, the external diameter of the support member 38 may be at least 5% greater but less than 50% greater than the external diameter of tubular steel forming body 14.

Figure 11:
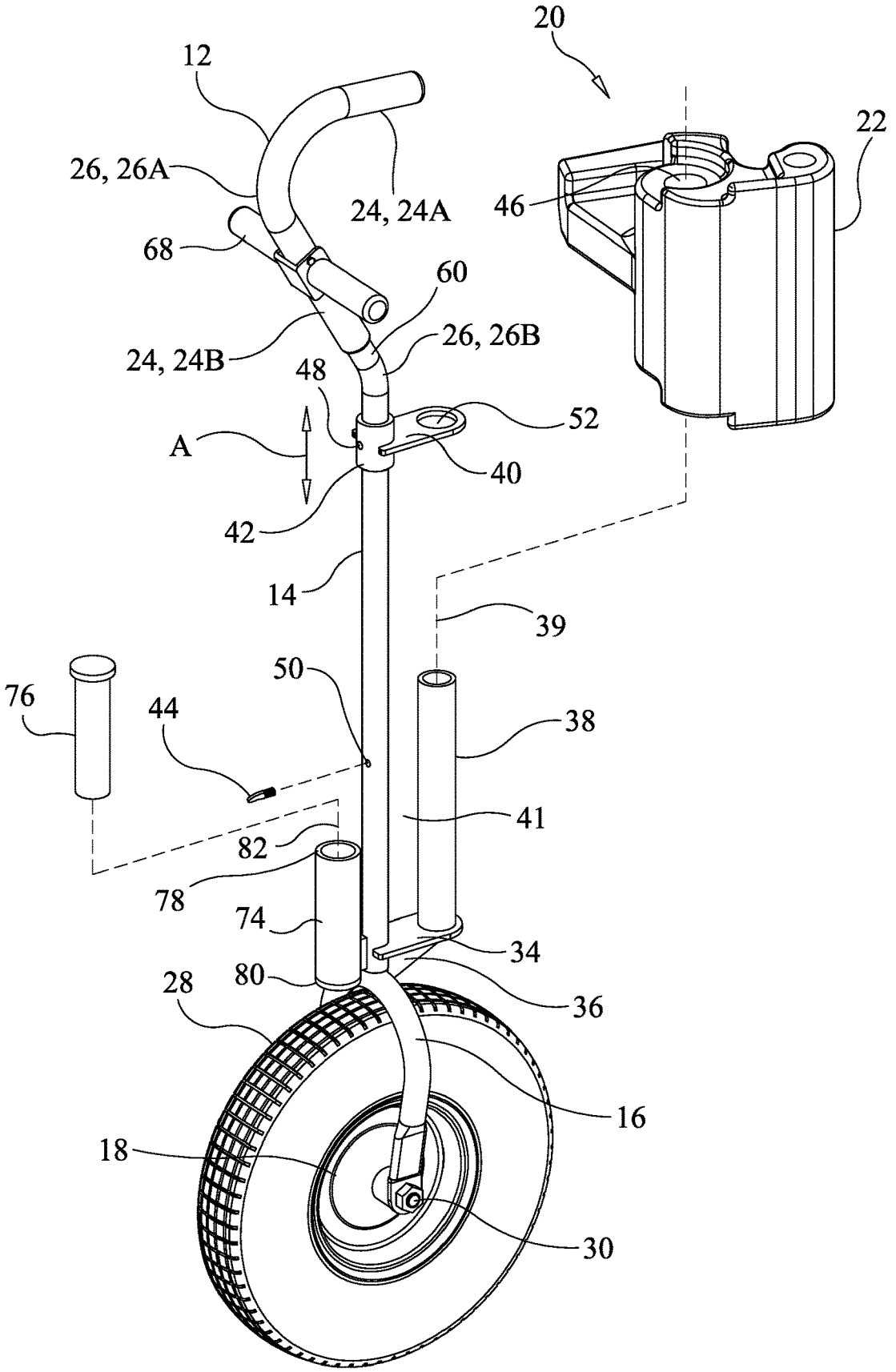
FIG. 11 (FIG. 11) is an operational view of a compact knuckle carrier, according to one aspect of the present disclosure.
Figure 12:
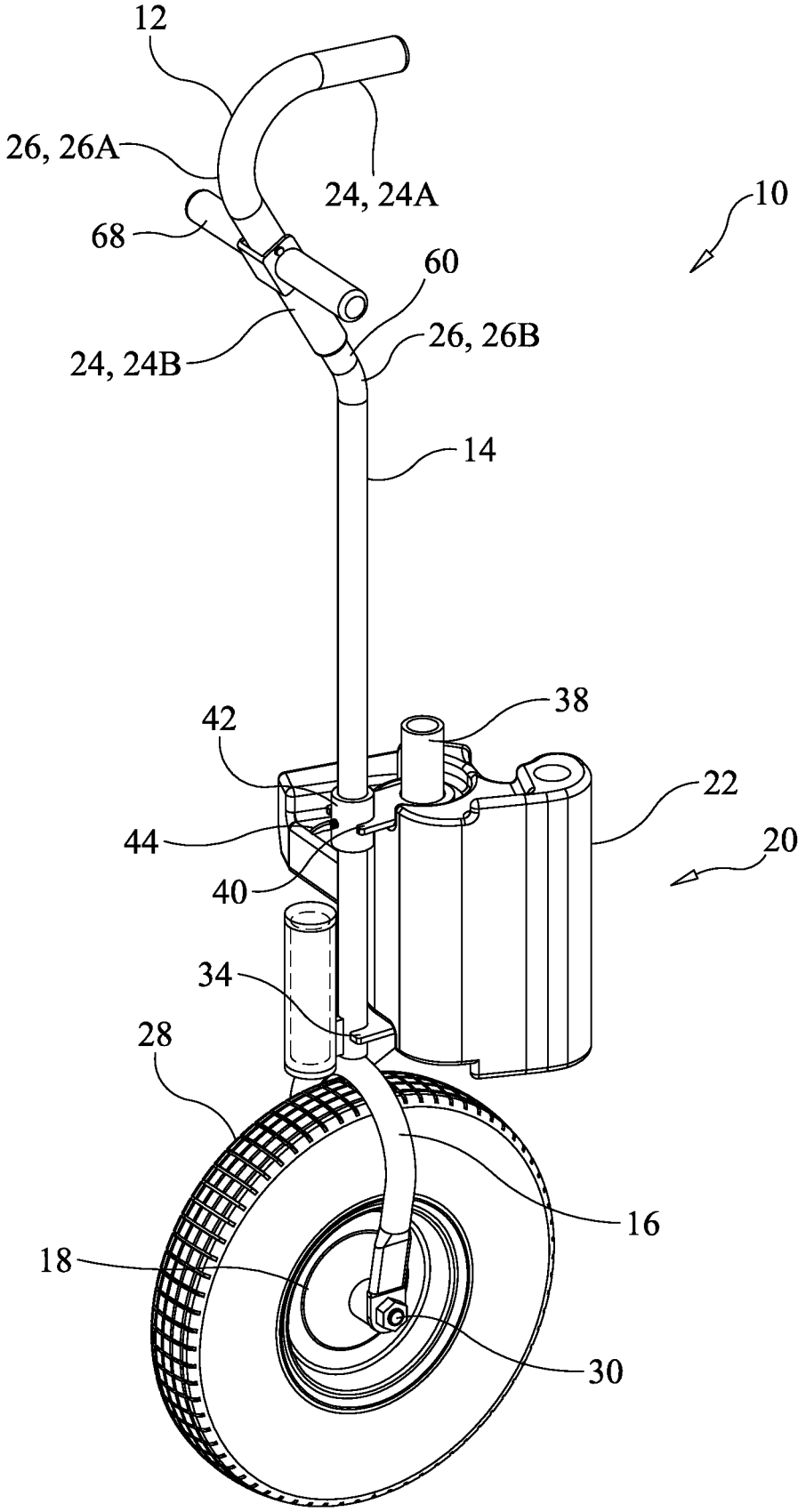
FIG. 12 (FIG. 12) is an operational view of a compact knuckle carrier, according to one aspect of the present disclosure.
Figure 13:
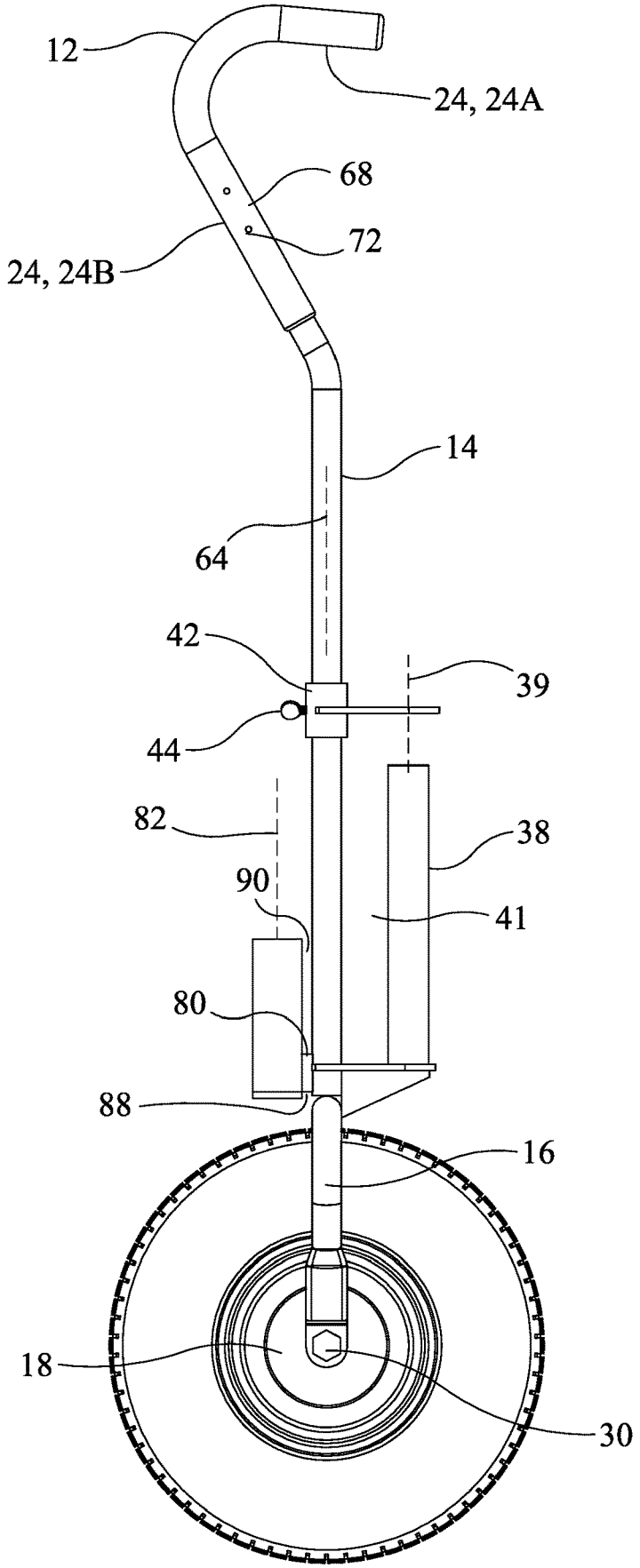
FIG. 13 (FIG. 13) is a right side elevation view of a compact knuckle carrier, according to one aspect of the present disclosure, shown without the cross bar.
Figure 14:
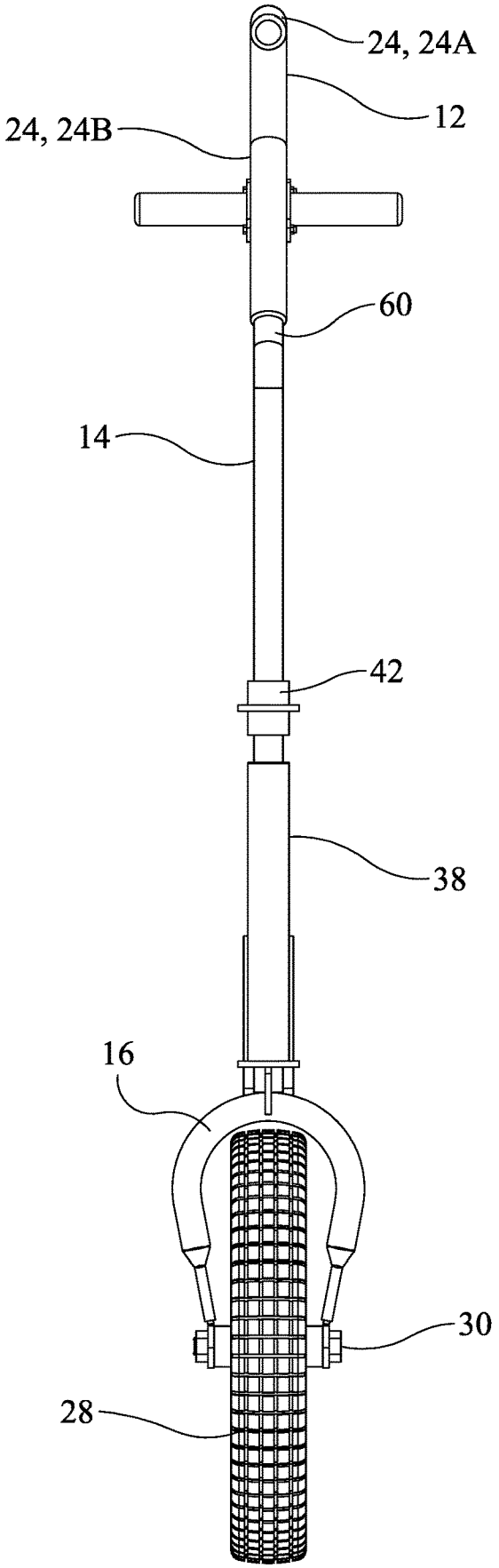
FIG. 14 (FIG. 14) is a front elevation view of a compact knuckle carrier, according to one aspect of the present disclosure, shown without the knuckle attached.

Lock plate 40 and lock collar 42 may be formed as a single unit, which may be vertically slidable about body 14 to allow clearance and space for knuckle 22 to be installed and removed from knuckle assembly 20, as described further below. Lock plate 40 and lock collar 42 may be formed of any suitable material such as steel or other similar metals and may include a thumbscrew 44, which may pass through a thumbscrew aperture 48 defined in collar 42 to interact with body 14, as discussed below, to secure lock plate 40 and lock collar 42 in position. According to one aspect (as best seen in FIG. 11), body 14 may further include a screw aperture 50 which may be complementary to thumbscrew aperture 48 in lock collar, which may allow thumbscrew 44 to interact with both lock collar 42 and body 14 to secure lock plate 40 and lock collar 42 in a specific position, which may be a position defined by the standardized size of a train knuckle 22. According to another aspect, screw aperture 50 may be omitted and thumbscrew 44 may operate on a tension principle wherein the tension between thumbscrew 44 and body 14 may secure or hold lock plate 40 and lock collar 42 in position, as desired. Lock plate 40 may further define an aperture 52 which may be placed and sized to accept a portion of support member 38 therethrough as to further secure knuckle 22 thereon, as discussed further below. Aperture 52 is best seen in FIG. 11. In other embodiments, another type of lock can be utilized in lieu of lock plate 40. Accordingly, a non-slidable lock can be used as lock for the carrier 10 without departing from the scope of the present disclosure.

Carrier 10 additionally a knuckle pin holder 74, which may simply referred to as a pin holder 74. A knuckle pin 76 is a pin or connector that is used to connect the coupler knuckle 22 with another coupler knuckle on an adjacent train car. One exemplary knuckle pin 76 has a length of 13⅜ inches and has a diameter of 1⅝ inches and is drilled with or otherwise defines a small aperture at one end for a cotter pin. The weight of an exemplary pin 76 is about 10 pounds (lbs). The pin 76 can be made from AISI C1060 or equal steel having a tensile strength (ksi) of 135 ksi, yield strength (ksi) of 75.2 ksi, elongation (%) of 18.5%, reduction in area (%) of 44.8%, and machined to RMS 125 straight within 0.050-inch.

The pin holder 74 has a first end 78 or upper end that is spaced apart from a second end 80 or lower/bottom end. The pin holder 74 has a length that is measured from the first end to the second end. The pin holder extends centrally along a pin holder axis 82. Pin holder axis 82 is offset parallel to axis 64 of body 14 and parallel to support member axis 39. The body axis 64 is located between pin holder axis 82 and support member axis 39. The pin holder 74 is constructed from sturdy tubular steel having an open upper end 78 and enclosed bottom end 80 that allows the pin 76 to be stored within the bore of the pin holder 74 while carrier 10 is being operated. The tubular steel construction of the pin holder 74 provides strength and resilience to withstand the dynamic forces experienced in the transportation environment.

The pin holder 74 is securely and rigidly attached to the body 14 of the carrier 10, ensuring stability during train operations and minimizing any potential for movement or play. In the shown embodiment, a rigid flange 84 connects near the bottom or second end 80 of the pin holder 74. The rigid flange 84 may have a top edge 86 and a bottom edge 88. When the carrier 10 is lifted upright such that the longitudinal axis 64 of the body 14 is aligned vertically, the top edge 86 of the rigid flange 84 is located above or higher than the support plate 34 and the bottom edge 88 of the rigid flange is located below or lower than the support plate 34. Further, the bottom edge 88 of the rigid flange 84 is located at a height that is intermediate the top and bottom ends of the support gusset 36. The rigid flange 84 has a width that spaces the pin holder 74 away from the body 14 defining gap 90.

In another embodiment, the pin holder 74 is securely and rigidly directly attached directly to the body of the carrier without the need for the rigid flange which would eliminate the gap. Given that the pin holder 74 is a rigid component, the pin holder 74 can be directly attached to the exterior surface of the body 14 of the carrier 10. For example, the pin holder 74 has an exterior surface that can be welded directly to the exterior surface of the body 14 of the carrier 10. This still results in a pin holder axis 82 that is offset from the longitudinal axis 64 of the body 14 of carrier 10.

Regardless of the connection of the pin holder to the body 14 of the carrier 10, the length of the pin holder 74 is tailored to accommodate the specific design and requirements of the carrier 10, providing sufficient space for the attachment and secure carrying of the knuckle pin 76. In one embodiment, the pin holder 74 defines a bore having an inner diameter that is greater than the exterior diameter of the pin 76 that it shall carry. Thus, when the pin 76 has an external diameter of 1⅝" diameter, the inner diameter of the bore of the pin holder 74 should be greater than 1⅝". In one particular embodiment, the inner diameter of the bore of the pin holder 74 is at least 5% greater than 1⅝" or at least at least 5% greater than the external diameter of the pin 76 that is to be carried by the pin holder 74. In another particular embodiment, the inner diameter of the bore of the pin holder 74 is at least 10% greater than 1⅝" or at least at least 10% greater than the external diameter of the pin 76 that is to be carried by the pin holder 74. In yet another particular embodiment, the inner diameter of the bore of the pin holder 74 is at least 25% greater than 1⅝" or at least at least 25% greater than the external diameter of the pin 76 that is to be carried by the pin holder 74. In each embodiment, the diameter of the tubular steel forming the pin holder 74 should be engineered to meet strength and load-bearing criteria, balancing the need for robustness with considerations for weight and space constraints.

The tubular steel forming portions of the body 14, the support plate 34, the gusset 36, the support member 38, and the pin holder 74 may be treated or coated to resist corrosion, ensuring the longevity of the carrier 10 even when exposed to various environmental conditions.

Having thus described the elements and components of carrier 10, the use and operation thereof will now be discussed.

With reference to FIG. 1 through FIG. 14, but with particular reference to FIG. 11 through FIG. 14, carrier 10 may be utilized in transporting a train coupler knuckle, such as knuckle 22, across distance. Specifically, as mentioned above, carrier 10 may offer a lightweight, compact, easily stored system for carrying a train knuckle from a first point to a second point. It is common in the railroad industry for trains, particularly long and heavily-laden freight trains, to suffer a breakage or failure of a coupling knuckle, such as knuckle 22 which is operable to couple adjacent railcars within the train. When a knuckle fails, it typically cannot be repaired and/or cannot be repaired onsite. Therefore, it is common practice to have one or more spare knuckles, such as knuckle 22, onboard the engine for ready replacement in the event of a knuckle failure. In such an event, the engineer or other operator must retrieve a replacement knuckle from its storage position and transport it to the location of the knuckle failure. Often, as these trains can be long, with some stretching over 1.5 miles or more, the railroad employee/operator or engineer must transport the knuckle a significant distance from its storage position in the engine compartments to the location of the knuckle failure. As these knuckles can be heavy, this is a daunting task that often requires a second person and/or some form of transport device. Carrier 10, therefore, may be utilized in transporting a knuckle over distance and over potentially rough terrain such as ballast or other uneven surfaces typically found surrounding train tracks, while sparing the engineer the need for a second person and/or providing relief in transporting a heavy replacement knuckle over a long distance.

Accordingly, in the event of a knuckle failure wherein a replacement knuckle is required, the engineer or train operator may first retrieve carrier 10 from a storage position given that carrier 10 is compact and only utilizes a single wheeled assembly, it may be more easily and readily stored and retrieved while taking up minimal space of already limited space within the locomotive cabin. Alternatively, carrier 10 configured as described herein, can be stored in other less conventional or common ways such as hanging carrier 10 from an elevated position such as a ceiling, wall, or the like via a hook. Further, given the strength of materials and robustness of carrier 10, carrier 10 may be stored on an exterior wall of the engine if desired so as to not occupy space within the locomotive engine cabin.

Once the operator retrieves carrier 10 from its storage position, the operator may install a knuckle 22 thereon. Specifically, as best seen in FIG. 11, the operator may remove or loosen thumbscrew 44 from lock collar 42 and may slide lock collar 42 vertically along body 14 to provide clearance for knuckle 22. The sliding lock collar 42 vertically is indicated by Arrow A in FIG. 11. Once the lock collar 42 and lock plate 40 are clear of support member 38, knuckle 22 may be moved into position over support member 38 as indicated by the dashed lines in FIG. 11. Namely, the aperture 46 on knuckle 22 is aligned with the support member 38 and slid downwardly towards the wheel 18 with the aperture 46 slidably receiving the support member 38. Once knuckle 22 is slid down over support member 38 and placed in contact with support plate 34, lock collar 42 may be slid downward into position above knuckle 22 such that aperture 52 in lock plate 40 may slide over a portion of support member 38 and contact an upper portion of knuckle 22. Once in position, thumbscrew 44 may be tightened and, in embodiments wherein body 14 includes a screw aperture 50, thumbscrew 44 may be aligned therewith and tightened to have at least a portion inserted into aperture 50 to secure lock collar 42 and lock plate 40 in position, thus further securing knuckle 22 onto support member 38. In embodiments wherein aperture 50 is not present, thumbscrew 44 may be tightened until sufficient tension exists to secure lock collar 42 and lock plate 40 in position.

Then, to install the pin 76 in the pin holder 74, the operator will grasp the pin 76 and bring it toward the pin holder 74 along axis 82 on the carrier 10. The end of the pin 76 will be aligned with the top opening at the first end 78 of the pin holder 74. The operator will then move the end of the pin 76 downward through the top opening of pin holder 74. Inasmuch as the external diameter of the pin 76 is smaller than the internal diameter of the bore of the pin holder 74, the pin 76 will slide downward into the inside of the pin holder 74. The operator may carefully lower the pin 76 until the end of the pin reaches the closed bottom or second end 80 of the pin holder 74. Alternatively, the operator may utilize gravitational forces and simply drop the pin 76 within the bore of the pin holder 74. Although not shown, it is entirely possible for a pin lock mechanism to lock the pin within the pin holder. For example, a second slide lock can be utilized to lock the pin to the pin holder. However, other types of locks are entirely possible instead of a slide lock.

The weight of the exemplary knuckle pin 76 is approximately 10 pounds, which contributes to its durability and ability to withstand the forces encountered during train operations. The material composition and mechanical properties of the pin ensure reliable performance in the demanding railway environment. Overall, the knuckle pin 76 serves as beneficial element in the efficient coupling and decoupling of train cars, contributing to the safe and reliable operation of the entire train system.

With knuckle 22 and pin 76 installed on knuckle assembly 20 and carrier 10, the engineer may then utilize handle 12 having cross bar 68 and/or grips 24 to steer and/or otherwise transport (i.e., push or pull) knuckle 22 to the desired location, i.e. the location of knuckle failure, to allow replace of the damaged or broken knuckle 22. As configured and shown in the figures, it is contemplated that, during operation, the knuckle 22 will be transported above body 14 as the T-handle is lowered to allow for the operator to utilize carrier 10. The lowering of the handle "tilts" the carrier towards the ground to define an acute angle of the body 14 relative to the ground surface. This configuration further supports the weight of the knuckle above the wheel making carrier 10 more efficient and easier to maneuver as opposed to the weight of the knuckle being supported below the body 14 of carrier 10. This further allows the weight of knuckle 22 to be distributed throughout the entire carrier 10 and reduces the stress and fatigue placed on support member 38, support plate 34, and gusset 36. Stated otherwise, carrier 10 is tilted, the coupler knuckle 22 is supported by the knuckle carrier 10 in a position above the body 14 of the knuckle carrier 10 when the knuckle carrier is operated at an acute angle relative to a ground surface; and the pin 76 is carried by the pin holder 74 in a position below the body 14 of the knuckle carrier 10 when the knuckle carrier is operated at an acute angle relative to a ground surface.

Once the knuckle 22 is transported to the desired location, the replacement knuckle 22 may be removed from carrier by reversing the previous steps. In particular, thumbscrew 44 may be loosened and lock collar 42 and lock plate 40 may be slid vertically out of the way and knuckle 22 may be raised up and off of support member 38 to remove it therefrom. Once the broken or damaged knuckle on the train is replaced with knuckle 22, the broken or damaged knuckle may be similarly transported back to the engine compartment for storage and transport to a railyard or repair location, as desired or necessary.

To connect two train cars, the knuckle pin 76 is inserted into the aperture or bore of one coupler knuckle 22, extending through to the corresponding knuckle on the adjacent car. The tight fit and secure placement of the pin 76 within the knuckle ensure a robust connection between the two cars. The small aperture in the pin 76 allows for the insertion of a cotter pin, providing an additional layer of safety by preventing accidental disengagement.

When it comes to the removal of the knuckle pin 76 to separate the two knuckles, the process is relatively straightforward. The cotter pin is first removed, allowing for the extraction of the knuckle pin 76. The pin 76 can be removed manually or through the use of specialized tools, depending on the design and requirements of the coupler system. Once the pin 76 is withdrawn, the two knuckles can be separated, facilitating the uncoupling of the train cars.

Carrier 10 has recognized that it is advantageous to carry the pin 76 along with the coupler knuckle 22 to the location of where the broken knuckle is to be replaced. Accordingly, the pin holder 74 is provided on body of the carrier 10. In one embodiment of carrier 10, the pin holder 74 is located along the body near the single wheel. This should assist in lowering the center of gravity of carrier 10 when the pin 76 and knuckle 22 are attached to the carrier 10. In one particular embodiment, the pin holder 74 is located on an opposite side of the body 14 than the support member 38. Thus, if the body 14 of carrier 10 is a single length of material, such as tubular steel or other similar materials, that extends vertically along the central axis 64 between handle 12 at a first end and wheel fork 16 at a second end, then the support member 38 is located on a first side of the body 14 and the pin holder 74 is located on an opposite second side of the body 14.

Accordingly, carrier 10 may provide a single wheeled compact and easily stored system which may allow a single individual to transport a heavy knuckle, such as knuckle 22 along with the pin 76 (via the pin holder 74), over a significant distance with reduced fatigue and/or stress applied to the train employee and without the need for a second individual. This may allow for a more safe operation as injuries caused by fatigue may be reduced and the second individual may monitor or maintain the engine and/or train while the user of carrier 10 may handle the replacement of a broken or damaged knuckle. Accordingly, carrier 10 provides benefits in the railroad industry in that it is compact and easily stored, taking up minimal space while providing a robust and safer system for use by a single individual in transporting and utilizing knuckle 22, as described herein.

Although not required, the carrier 10 may additionally include one or more sensors to sense or gather data pertaining to the surrounding environment or operation of the carrier 10. Some exemplary sensors capable of being electronically coupled with the carrier 10 (either directly connected to the carrier 10 or remotely connected thereto) may include but are not limited to: accelerometers sensing accelerations experienced during rotation, translation, velocity/speed, location traveled, elevation gained; gyroscopes sensing movements during angular orientation and/or rotation, and rotation; altimeters sensing barometric pressure, altitude change, terrain climbed, local pressure changes, submersion in liquid; impellers measuring the amount of fluid passing thereby; Global Positioning sensors sensing location, elevation, distance traveled, velocity/speed; audio sensors sensing local environmental sound levels, or voice detection; Photo/Light sensors sensing ambient light intensity, ambient, Day/night, UV exposure; TV/IR sensors sensing light wavelength; Temperature sensors sensing machine or motor temperature, ambient air temperature, and environmental temperature; and Moisture Sensors sensing surrounding moisture levels.

If sensors are utilized to gather data relating to the carrier 10, then sensed data may be evaluated and processed with artificial intelligence (AI). Analyzing data gathered from sensors using artificial intelligence involves the process of extracting meaningful insights and patterns from raw sensor data to produce refined and actionable results. Raw data is gathered from various sensors, for example those which have been identified herein or others, capturing relevant information based on the intended analysis. This data is then preprocessed to clean, organize, and structure it for effective analysis. Features that represent key characteristics or attributes of the data are extracted. These features serve as inputs for AI algorithms, encapsulating relevant information essential for the analysis. A suitable AI model, such as machine learning or deep learning (regardless of whether it is supervised or unsupervised), is chosen based on the nature of the data and the desired analysis outcome. The model is then trained using labeled or unlabeled data to learn the underlying patterns and relationships. The model is fine-tuned and optimized to enhance its performance and accuracy. This process involves adjusting parameters, architectures, and algorithms to achieve better results. The trained model is used to make predictions or inferences on new, unseen data. The model processes the extracted features and generates refined output based on the patterns it has learned during training. The results produced by the AI model are refined through post-processing techniques to ensure accuracy and relevance. These refined results are then interpreted to extract meaningful insights and derive actionable conclusions. Feedback from the refined results is used to improve the AI model iteratively. The process involves incorporating new data, adjusting the model, and enhancing the analysis based on real-world feedback and evolving requirements.

The carrier 10 may include wireless communication logic coupled to sensors on the carrier 10. The sensors gather data and provide the data to the wireless communication logic. Then, the wireless communication logic may transmit the data gathered from the sensors to a remote device. Thus, the wireless communication logic may be part of a broader communication system, in which one or several devices, assemblies, or systems of the present disclosure may be networked together to report alerts and, more generally, to be accessed and controlled remotely. Depending on the types of transceivers installed in the device, assembly, or system of the present disclosure, the system may use a variety of protocols (e.g., Wi-Fi®, ZigBee®, MIWI, BLUETOOTH®) for communication. In one example, each of the devices, assemblies, or systems of the present disclosure may have its own IP address and may communicate directly with a router or gateway. This would typically be the case if the communication protocol is Wi-Fi®. (Wi-Fi® is a registered trademark of Wi-Fi Alliance of Austin, TX, USA; ZigBee® is a registered trademark of ZigBee Alliance of Davis, CA, USA; and BLUETOOTH® is a registered trademark of Bluetooth Sig, Inc. of Kirkland, WA, USA).

The system that receives and processes signals from the carrier 10 may differ from embodiment to embodiment. In one embodiment, alerts and signals from the carrier 10 are sent through an e-mail or simple message service (SMS; text message) gateway so that they can be sent as e-mails or SMS text messages to a remote device, such as a smartphone, laptop, or tablet computer, monitored by a responsible individual, group of individuals, or department, such as a train maintenance department. Thus, if a particular carrier 10 creates an alert because of a data point gathered by one or more sensors, that alert can be sent, in e-mail or SMS form, directly to the individual responsible for fixing it. Of course, e-mail and SMS are only two examples of communication methods that may be used; in other embodiments, different forms of communication may be used.

In other embodiments, alerts and other data from the sensors on the carrier 10 may also be sent to a work tracking system that allows the individual, or the organization for which he or she works, to track the status of the various alerts that are received, to schedule particular workers to repair a particular carrier 10, and to track the status of those repair jobs. A work tracking system would typically be a server, such as a Web server, which provides an interface individuals and organizations can use, typically through the communication network. In addition to its work tracking functions, the work tracker may allow broader data logging and analysis functions. For example, operational data may be calculated from the data collected by the sensors on the carrier 10, and the system may be able to provide aggregate machine, train, train car, or knuckle 22 operational data for a carrier 10 or system of the present disclosure.

As described herein, aspects of the present disclosure may include one or more electrical, pneumatic, hydraulic, or other similar secondary components and/or systems therein. The present disclosure is therefore contemplated and will be understood to include any necessary operational components thereof. It will be further understood that any connections between various components not explicitly described herein may be made through any suitable means including mechanical fasteners, or more permanent attachment means, such as welding or the like. Alternatively, where feasible and/or desirable, various components of the present disclosure may be integrally formed as a single unit.

Unless explicitly stated that a particular shape or configuration of a component is mandatory, any of the elements, components, or structures discussed herein may take the form of any shape. Thus, although the figures depict the various elements, components, or structures of the present disclosure according to one or more exemplary embodiments, it is to be understood that any other geometric configuration of that element, component, or structure is entirely possible. For example, instead of the various tubing being circular in cross-section, the tubing can be semicircular, triangular, rectangular or square, pentagonal, hexagonal, heptagonal, octagonal, decagonal, dodecagonal, diamond shaped or another parallelogram, trapezoidal, star-shaped, oval, ovoid, lines or lined, teardrop-shaped, cross-shaped, donut-shaped, heart-shaped, arrow-shaped, crescent-shaped, any letter shape (i.e., A-shaped, B-shaped, C-shaped, D-shaped, E-shaped, F-shaped, G-shaped, H-shaped, I-shaped, J-shaped, K-shaped, L-shaped, M-shaped, N-shaped, O-shaped, P-shaped, Q-shaped, R-shaped, S-shaped, T-shaped, U-shaped, V-shaped, W-shaped, X-shaped, Y-shaped, or Z-shaped), or any other type of regular or irregular, symmetrical or asymmetrical configuration.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A knuckle carrier comprising:

a body having a first end and a second end;

a handle at the first end of the body;

a single wheel at the second end of the body;

a knuckle attachment assembly including a support member coupled to the body of the knuckle carrier, the support member configured to carry a coupler knuckle; and a knuckle pin holder coupled to the body, the knuckle pin holder configured to hold a knuckle pin that is used to connect the coupler knuckle to another coupler knuckle on an adjacent train car when both the knuckle pin and couple knuckle are removed from the knuckle carrier.

2. The knuckle carrier of claim 1, further comprising:

a support plate attached to the body proximate the wheel;

wherein the support member extends vertically from the support plate, wherein the support plate and the support member are located on a different side of the body than the pin holder.

3. The knuckle carrier of claim 1, further comprising:

a flange attached to the body proximate the wheel; and wherein the pin holder is connected to the flange and spaced apart from the body.

4. The knuckle carrier of claim 3, further comprising:

a top edge of the flange and a bottom edge of the flange;

a support plate attached to the body proximate the wheel;

wherein the top edge of the flange is located at greater vertical height than the support plate; and wherein the support member extends vertically from the support plate, wherein the support plate and the support member are located on a different side of the body than the pin holder.

5. The knuckle carrier of claim 3, further comprising:

a top edge of the flange and a bottom edge of the flange;

a support plate attached to the body proximate the wheel;

wherein the bottom edge of the flange is located at lower vertical height than the support plate; and wherein the support member extends vertically from the support plate, wherein the support plate and the support member are located on a different side of the body than the pin holder.

6. The knuckle carrier of claim 3, further comprising:

a support gusset connected to the body and the support plate, wherein a lower end of the support gusset is located at a lower vertical height than a top edge of the flange.

7. The knuckle carrier of claim 3, further comprising:

a support gusset connected to the body and the support plate, wherein a lower end of the support gusset is located at a lower vertical height than a bottom edge of the flange.

8. The knuckle carrier of claim 1, wherein the pin holder is on an opposite side of the body than the support member.

9. The knuckle carrier of claim 1, further comprising:

a length of the pin holder; and a length of the support member, wherein the support member is longer than the pin holder.

10. The knuckle carrier of claim 1, wherein the body is a singular body, wherein the support member is formed from tubular metal, and wherein the pin holder is formed from tubular metal.

11. The knuckle carrier of claim 10, further comprising: an external diameter of the tubular metal that forms the support member, wherein the external diameter is smaller than an internal diameter of an aperture defined in the coupler knuckle.

12. The knuckle carrier of claim 10, further comprising:

an internal diameter of the tubular metal that forms the pin holder, wherein the pin holder has an enclosed bottom and an open top so as to receive the pin within a bore of the tubular metal, wherein the internal diameter is larger than an external diameter of the pin that is held by the pin holder.

13. The knuckle carrier of claim 1, wherein the handle further comprises:

a first curved portion and a second curved portion;

a straight section located between the first curved portion and the second curved portion;

at least one aperture formed in the straight section, wherein the at least one aperture in the straight section is configured to receive a connector for an attachment that couples with the straight section.

14. The knuckle carrier of claim 13, wherein the attachment that connects with the straight section is a cross bar that establishes a T-handle.

15. The knuckle carrier of claim 1, wherein the handle is a T-handle.

16. The knuckle carrier of claim 1, wherein the handle further comprises:

a first curved portion and a second curved portion;

a straight section located between the first curved portion and the second curved portion;

a cross bar coupled to the straight section, wherein the cross bar is adapted to be gripped by both hands of an operator; and wherein the second curved portion is located above the cross bar.

17. The knuckle carrier of claim 1, wherein the coupler knuckle is supported by the knuckle carrier in a position above the body of the knuckle carrier when the knuckle carrier is operated at an acute angle relative to a ground surface.

18. The knuckle carrier of claim 1, further comprising:

a slidable lock plate and lock collar formed as a singular unit, wherein the lock collar slides along the body, wherein sliding movement of the singular movement has a clearance above the support member that is adapted to allow space for the coupler knuckle to be installed on and removed from the support member.

19. The knuckle carrier of claim 1, further comprising:

a lock that is operable to lock the coupler knuckle on the support member.

20. The knuckle carrier of claim 1, further comprising:

a support plate attached to the body of the knuckle carrier proximate the wheel;

wherein the support member extends vertically from the support plate; and a slidable lock operable to lock the coupler knuckle in place on the support member, wherein the slidable lock defines an aperture operable to engage at least a portion of the support member, and wherein the slidable lock further comprises:

a lock collar having a thumbscrew aperture defined therethrough; and a thumbscrew operable to engage the thumbscrew aperture in the lock collar and the body of the knuckle carrier to secure the lock collar and lock plate in position relative to the body of the knuckle carrier;

at least two grips on the handle of the body;

wherein the knuckle carrier is operable to be stored within an engine of a locomotive train;

wherein the coupler knuckle is supported by the knuckle carrier in a position above the body of the knuckle carrier when the knuckle carrier is operated at an acute angle relative to a ground surface; and wherein the pin is carried by the pin holder in a position below the body of the knuckle carrier when the knuckle carrier is operated at an acute angle relative to a ground surface.

* * * * *